US011732594B2

(12) United States Patent
Rathay et al.

(10) Patent No.: US 11,732,594 B2
(45) Date of Patent: Aug. 22, 2023

(54) COOLING ASSEMBLY FOR A TURBINE ASSEMBLY

(71) Applicant: General Electric Company, Schenectady, NY (US)

(72) Inventors: Nicholas William Rathay, Rock City Falls, NY (US); Thomas Earl Dyson, Niskayuna, NY (US); Brian Brzek, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 25 days.

(21) Appl. No.: 16/697,242

(22) Filed: Nov. 27, 2019

(65) Prior Publication Data

US 2021/0156265 A1 May 27, 2021

(51) Int. Cl.
*F01D 5/18* (2006.01)

(52) U.S. Cl.
CPC ..... *F01D 5/189* (2013.01); *F01D 5/186* (2013.01); *F05D 2240/121* (2013.01); *F05D 2240/304* (2013.01); *F05D 2250/711* (2013.01); *F05D 2260/202* (2013.01); *F05D 2260/2212* (2013.01)

(58) Field of Classification Search
CPC ..... F01D 5/186; F01D 5/187; F01D 5/188; F01D 5/189; F05D 2260/201; F05D 2260/202
See application file for complete search history.

(56) References Cited

U.S. PATENT DOCUMENTS 5,464,322 A * 11/1995 Cunha ..... F01D 5/187 415/115
5,842,829 A 12/1998 Cunha et al.
(Continued)

FOREIGN PATENT DOCUMENTS

EP 1741875 A1 1/2007
WO WO2011050025 A2 4/2011

OTHER PUBLICATIONS

Siw et al., "Detailed Experimental Characterization of Heat Transfer Coefficient over the Internal Cooling Passages of an Additive Manufactured Turbine Airfoil", Turbo Expo: Power for Land Sea, and Air, Sep. 20, 2016, pp. 1-11.
(Continued)

*Primary Examiner* — Topaz L. Elliott
*Assistant Examiner* — Michael K. Reitz
(74) *Attorney, Agent, or Firm* — Dority & Manning, P.A.

(57) ABSTRACT

A cooling assembly includes a coolant chamber disposed inside an airfoil of a turbine assembly that directs coolant inside the airfoil. The airfoil extends between a leading edge and a trailing edge along an axial length of the airfoil. Inlet cooling channels are fluidly coupled with the coolant chamber and direct the coolant in a direction toward a trailing edge chamber of the airfoil. The trailing edge chamber is fluidly coupled with at least one inlet cooling channel. The trailing edge chamber is disposed at the trailing edge of the airfoil and includes an inner surface. The inlet cooling channels direct at least a portion of the coolant in a direction toward the inner surface of the trailing edge chamber. One or more outlet cooling channels direct at least a portion of the coolant in one or more directions away from the trailing edge chamber.

18 Claims, 8 Drawing Sheets

(56) References Cited

U.S. PATENT DOCUMENTS

| | | | | |
|---|---|---|---|---|
| 7,513,739 | B2 * | 4/2009 | Boury | F01D 5/187 415/115 |
| 8,864,469 | B1 | 10/2014 | Liang | |
| 9,296,039 | B2 | 3/2016 | Propheter-Hinckley | |
| 9,938,836 | B2 | 4/2018 | Weber et al. | |
| 10,260,354 | B2 | 4/2019 | Bunker | |
| 10,301,946 | B2 | 5/2019 | Weber et al. | |
| 2009/0185903 | A1 * | 7/2009 | Beeck | F02K 3/08 416/91 |
| 2010/0226755 | A1 * | 9/2010 | Liang | F01D 5/187 415/115 |
| 2012/0269647 | A1 * | 10/2012 | Vitt | F01D 5/186 416/97 R |
| 2016/0362985 | A1 * | 12/2016 | Lacy | F01D 5/147 |
| 2017/0044904 | A1 * | 2/2017 | Bunker | F01D 5/189 |
| 2017/0130591 | A1 | 5/2017 | Bunker | |
| 2018/0112533 | A1 | 4/2018 | Weber | |
| 2018/0112539 | A1 | 4/2018 | Weber | |
| 2018/0112540 | A1 * | 4/2018 | Hoskin | F01D 5/147 |
| 2018/0112541 | A1 | 4/2018 | Weber | |
| 2018/0112547 | A1 * | 4/2018 | Snider | F01D 5/187 |
| 2018/0223671 | A1 | 8/2018 | Marsh et al. | |
| 2018/0230815 | A1 * | 8/2018 | Jones | F01D 9/065 |
| 2019/0218917 | A1 | 7/2019 | Garay et al. | |

OTHER PUBLICATIONS

European Search Report Corresponding to Application No. 20198835 dated Jan. 29, 2021.

* cited by examiner

COOLING ASSEMBLY FOR A TURBINE ASSEMBLY

STATEMENT REGARDING FEDERALLY SPONSERED RESEACH AND DEVELOPMENT

This invention was made with government support under contract DE-FE0031616 awarded by the Department of Energy. The government has certain rights in the invention.

FIELD

The subject matter described herein relates to cooling turbine assemblies.

BACKGROUND

The turbine assembly can be subjected to increased heat loads when an engine is operating. To protect the turbine assembly components from damage, cooling fluid may be directed in and/or onto the turbine assembly. Component temperature can be managed through a combination of impingement onto, cooling flow through passages in the component, and film cooling with the goal of balancing component life and turbine efficiency. Improved efficiency can be achieved through increasing the firing temperature of the turbine, reducing the cooling flow, or a combination thereof.

As one example, an aft region of the turbine airfoil may be difficult to cool, with the region of highest temperature being at the trailing edge of the airfoil. The geometry of the trailing edge of the airfoil prohibits a thermal barrier coating from adhering to the small radius of curvature of the trailing edge, thereby reducing the thermal resistance between the hot gas and the airfoil.

One issue with cooling known turbine assemblies is inadequate coolant coverage at the aft regions of the turbine airfoil. Known turbine assemblies involve holes that may exhaust coolant out of the airfoil proximate the trailing edge. However, as the coolant moves within the airfoil toward the exhaust holes, the coolant receives thermal energy upstream of the trailing edge, thereby reducing an ability of the coolant to sufficiently cool the trailing edge of the airfoil. Alternatively, known assemblies exhaust coolant that may have a substantial amount of heat capacity left within the coolant (e.g., the coolant is still relatively cool), signifying that the cooling scheme is inefficient.

BRIEF DESCRIPTION

In one or more embodiments, a cooling assembly includes a coolant chamber disposed inside an airfoil of a turbine assembly. The coolant chamber directs coolant inside the airfoil of the turbine assembly. The airfoil extends between a leading edge of the airfoil and a trailing edge of the airfoil along an axial length of the airfoil. One or more inlet cooling channels are fluidly coupled with the coolant chamber and direct the coolant in a direction toward a trailing edge chamber of the airfoil. The trailing edge chamber is fluidly coupled with at least one of the one or more inlet cooling channels. The trailing edge chamber is disposed at the trailing edge of the airfoil and includes an inner surface. The one or more inlet cooling channels direct at least a portion of the coolant in a direction toward the inner surface of the trailing edge chamber. One or more outlet cooling channels direct at least a portion of the coolant in one or more directions away from the trailing edge chamber of the airfoil.

In one or more embodiments, a cooling assembly includes one or more coolant chambers disposed inside an airfoil of a turbine assembly. The one or more coolant chambers direct coolant inside the airfoil of the turbine assembly. The airfoil extends between a leading edge and a trailing edge along an axial length of the airfoil. One or more inlet cooling channels are fluidly coupled with at least one of the one or more coolant chambers and direct the coolant in a direction toward a trailing edge chamber of the airfoil. The trailing edge chamber is disposed at the trailing edge of the airfoil and includes an inner surface. The one or more inlet cooling channels direct at least a portion of the coolant in a direction toward the inner surface of the trailing edge chamber. One or more outlet cooling channels direct at least a portion of the coolant in one or more directions away from the trailing edge chamber of the airfoil. At least one of the one or more inlet cooling channels or the one or more outlet cooling channels is disposed along a suction side of the airfoil within the airfoil, and at least one of the one or more inlet cooling channels or the one or more outlet cooling channels is disposed along a pressure side of the airfoil. The at least one of the one or more inlet cooling channels or the one or more outlet cooling channels disposed along the suction side of the airfoil reduces an amount of heat transfer from a gas outside of the suction side of the airfoil to a portion of the coolant inside the airfoil, and the at least one of the one or more inlet cooling channels or the one or more outlet cooling channels disposed along the pressure side of the airfoil reduces an amount of heat transfer from a gas outside of the pressure side of the airfoil to a portion of the coolant inside the airfoil.

In one or more embodiments, a cooling assembly includes a coolant chamber disposed inside an airfoil of a turbine assembly. The coolant chamber directs coolant inside the airfoil of the turbine assembly. The airfoil extends between a leading edge of the airfoil and a trailing edge of the airfoil along an axial length of the airfoil. An inlet cooling channel is fluidly coupled with the coolant chamber and directs the coolant in a direction toward a trailing edge chamber of the airfoil. The trailing edge chamber is fluidly coupled with the inlet cooling channel. The trailing edge chamber is disposed at the trailing edge of the airfoil and includes an inner surface. The trailing edge chamber is fluidly coupled with one or more trailing edge conduits that direct at least a portion of the coolant out of the trailing edge chamber and out of the airfoil. One or more outlet cooling channels direct at least a portion of the coolant in one or more directions away from the trailing edge chamber of the airfoil. At least one of the inlet cooling channel or the one or more outlet cooling channels is disposed along a suction side of the airfoil within the airfoil and fluidly coupled with the suction side of the airfoil via one or more suction side conduits. The one or more suction side conduits direct a portion of the coolant out of the at least one of the inlet cooling channel or the one or more outlet cooling channels toward the suction side of the airfoil. At least one of the inlet cooling channel or the one or more outlet cooling channels is disposed along a pressure side of the airfoil within the airfoil and fluidly coupled with the pressure side of the airfoil via one or more pressure side conduits. The one or more pressure side conduits direct a portion of the coolant out of the at least one of the inlet cooling channel or the one or more outlet cooling channels toward the pressure side of the airfoil.

BRIEF DESCRIPTION OF THE DRAWINGS

The present inventive subject matter will be better understood from reading the following description of non-limiting embodiments, with reference to the attached drawings, wherein below.

DETAILED DESCRIPTION

One or more embodiments of the inventive subject matter described herein provide systems and methods that provide a cooling assembly to reduce a temperature of a trailing edge of an airfoil. One or more inlet cooling channels direct coolant from a coolant chamber within the airfoil toward the trailing edge of the airfoil, and one or more outlet cooling channels direct coolant in a direction away from the trailing edge of the airfoil. At least one of the inlet cooling channels is thermally isolated from one or more exterior surfaces of the airfoil by adjacent inlet and/or outlet cooling channels. For example, a middle cooling channel may be isolated from the pressure and suction sides of the airfoil by adjacent first and second outer cooling channels. The first and second outer cooling channels provide a thermal barrier or buffer between the middle cooling channel and the exterior surfaces of the airfoil. Coolant that moves within the middle cooling channel may impinge on an inner surface of a trailing edge chamber inside of the trailing edge of the airfoil and may be ejected out of the airfoil via one or more conduits.

Figure 1:
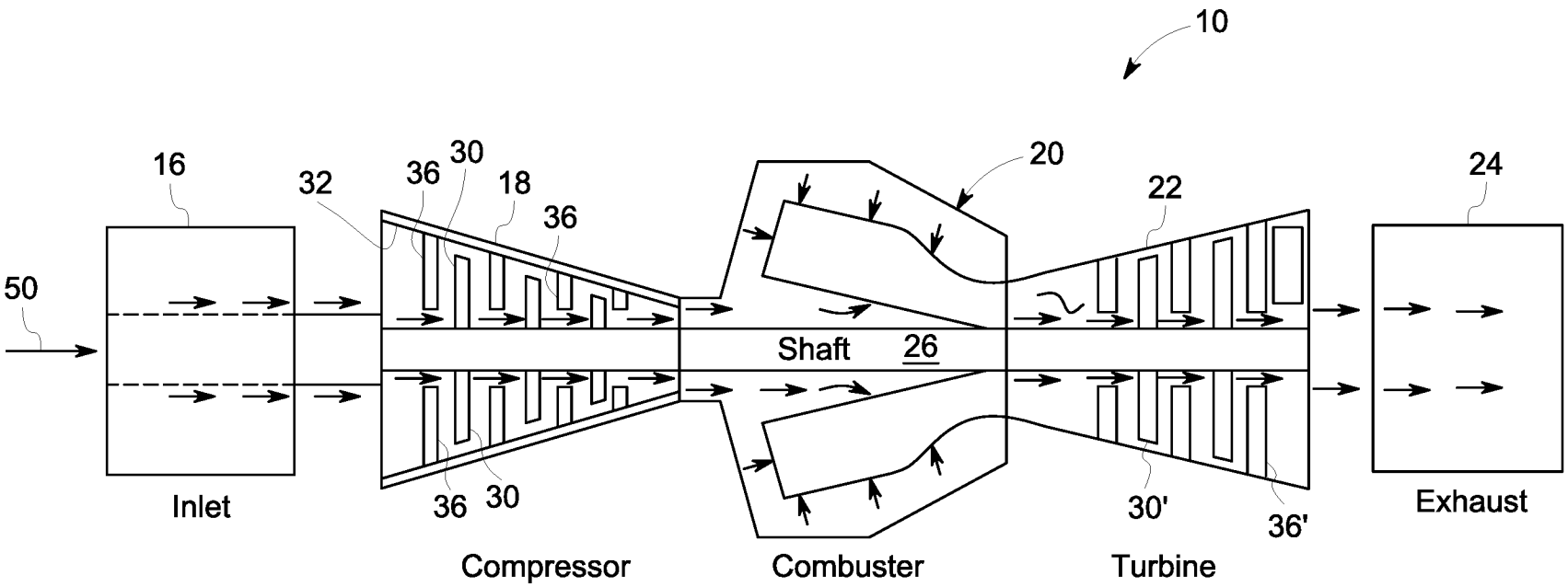
FIG. 1 illustrates a turbine assembly in accordance with one embodiment.

FIG. 1 illustrates a turbine assembly 10 in accordance with one embodiment. The turbine assembly 10 includes an inlet 16 through which air enters the turbine assembly 10 in the direction of arrow 50. The air travels in the direction 50 from the inlet 16, through the compressor 18, through a combustor 20, and through a turbine 22 to an exhaust 24. A rotating shaft 26 runs through and is coupled with one or more rotating components of the turbine assembly 10.

The compressor 18 and the turbine 22 comprise multiple airfoils. The airfoils may be one or more of blades 30, 30' or guide vanes 36, 36'. The blades 30, 30' are axially offset from the guide vanes 36, 36' in the direction 50. The guide vanes 36, 36' are stationary components. The blades 30, 30' are operably coupled with and rotate with the shaft 26.

Figure 2:
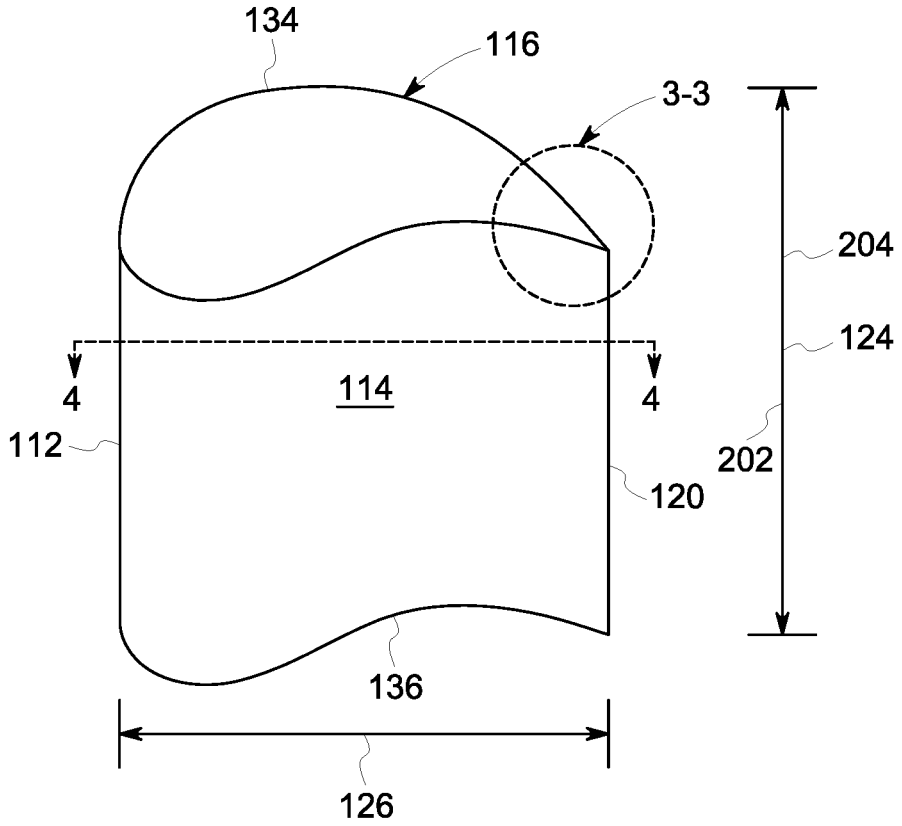
FIG. 2 illustrates a perspective view of an airfoil in accordance with one embodiment.

FIG. 2 illustrates a perspective view of an airfoil 100 in accordance with one embodiment. The airfoil 100 may be a turbine blade, a stationary guide vane, or the like, used in a turbine assembly (not shown). The airfoil 100 has a pressure side 114 and a suction side 116 that is opposite the pressure side 114. The pressure side 114 and the suction side 116 are interconnected by a leading edge 112 and a trailing edge 120 that is opposite the leading edge 112. The pressure side 114 is generally concave in shape, and the suction side 116 is generally convex in shape between the leading and trailing edges 112, 120. For example, the generally concave pressure side 114 and the generally convex suction side 116 provides an aerodynamic surface over which compressed working fluid flows through the turbine assembly.

The airfoil 100 extends an axial length 126 between the leading edge 112 and the trailing edge 120. The airfoil 100 also extends a radial length 124 between a first end 134 and a second end 136. For example, the axial length 126 is generally perpendicular to the radial length 124.

Figure 3:
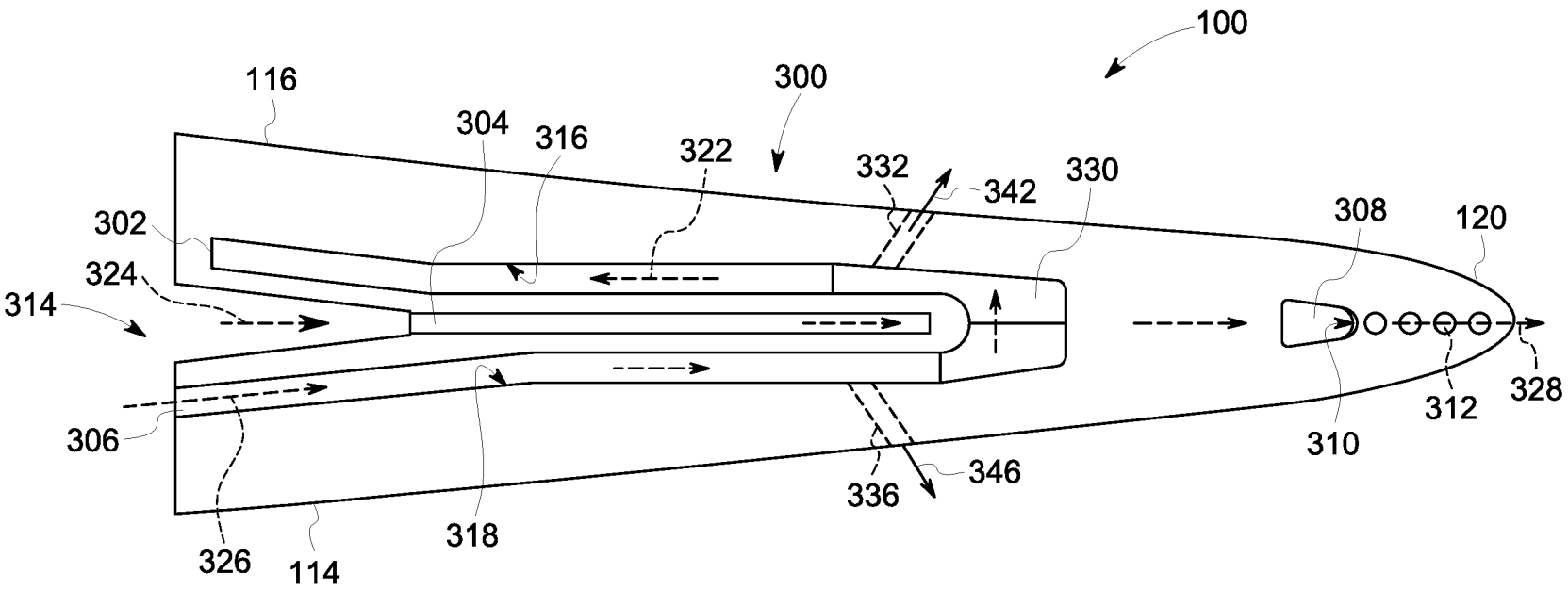
FIG. 3 illustrates a first cross-sectional view of a cooling assembly in accordance with one embodiment.
Figure 4:
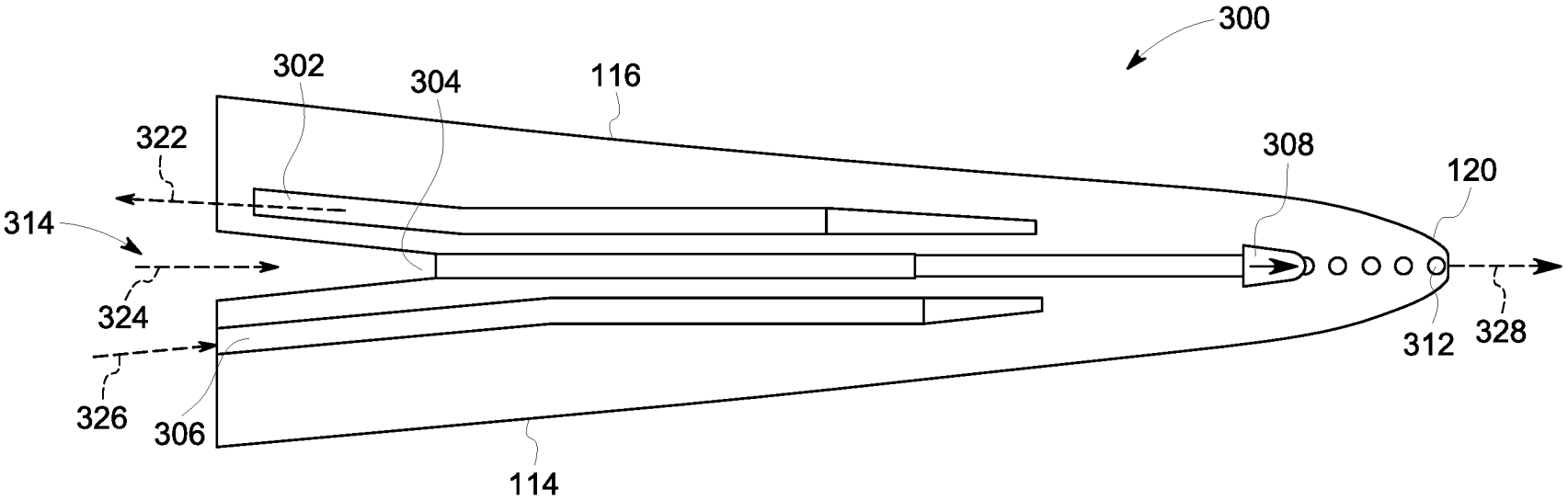
FIG. 4 illustrates a second cross-sectional view of the cooling assembly shown in FIG. 3.

FIG. 3 illustrates a first cross-sectional view of a cooling assembly 300 in accordance with one embodiment. FIG. 4 illustrates a second cross-sectional view of the cooling assembly 300. FIGS. 3 and 4 will be discussed in detail together. In one or more embodiments, the cooling assembly 300 may be referred to as a trailing edge cooling assembly 300 such that the cooling assembly 300 includes plural cooling channels that may direct coolant in one or more different directions within and/or outside the trailing edge of the airfoil 100, such as around and/or proximate to section A-A shown in FIG. 2, to reduce a temperature of the trailing edge 120 of the airfoil 100.

The cooling assembly 300 includes plural cooling channels that direct coolant in one or more directions within the airfoil proximate to the trailing edge 120 of the airfoil 100 to reduce a temperature of the trailing edge 120 of the airfoil inside and outside of the airfoil 100. FIG. 3 illustrates a cross-sectional view of the cooling assembly 300 at a first position 202 along the radial length 124 of the airfoil 100. Alternatively, FIG. 4 illustrates a cross-sectional view of the cooling assembly 300 at a second position 204 along the radial length 124 of the airfoil 100.

The cooling assembly 300 includes at least one coolant chamber 314 that is disposed inside the airfoil 100. The coolant chamber 314 contains coolant within the coolant chamber 314. The cooling chamber 314 may be fluidly coupled with plural cooling channels that may direct the coolant in plural different directions inside the airfoil 100, in particular inside and outside the airfoil 100 proximate the trailing edge 120 of the airfoil 100 relative to the leading edge 112 along the axial length 126 of the airfoil 100.

The coolant chamber 314 is fluidly coupled with inlet cooling channels 304, 306 that direct coolant in directions generally toward the trailing edge 120 of the airfoil 100. Additionally, the coolant chamber 314 is fluidly coupled with an outlet cooling channel 302 that directs coolant in a direction generally away from the trailing edge 120 of the airfoil 100. A second inlet cooling channel 304 directs at least a portion of the coolant from the coolant chamber 314 in a direction 324 generally toward a trailing edge chamber 308 disposed inside the airfoil 100 proximate the trailing edge 120 of the airfoil 100. Additionally, a first inlet cooling channel 306 directs at least a portion of the coolant from the coolant chamber 314 in a direction 326 generally toward the trailing edge chamber 308. The outlet cooling channel 302 directs at least a portion of the coolant in a direction 322 generally away from the trailing edge chamber 308.

In one or more embodiments, the first inlet cooling channel 306 may be fluidly coupled with a first coolant chamber (not shown), and the second inlet cooling channel 304 may be fluidly coupled with a different, second coolant chamber (not shown). For example, the first and second inlet cooling channels 306, 304 may receive coolant from different sources within the airfoil 100. Optionally, the outlet cooling channel 302 may be fluidly coupled with the first coolant chamber, the second coolant chamber, and/or a different, third coolant chamber (not shown).

The inlet cooling channels 304, 306, the outlet cooling channels 302, and the trailing edge chamber 308 may be fluidly coupled and/or fluidly separate from each other in one or more combinations. As illustrated in FIG. 3, the first inlet cooling channel 306 is fluidly coupled with the outlet cooling channel 302. Additionally, the second inlet cooling channel 304 is fluidly separate from the outlet cooling channel 302. For example, at least a portion of the coolant is directed from the coolant chamber 314 in the direction 326 toward the trailing edge 120 of the airfoil 100 via the first inlet cooling channel 306. The outlet cooling channel 302 receives the portion of the coolant from the first inlet cooling channel 306 and directs the portion of the coolant in the direction 322 generally toward the coolant chamber 314. For example, the first inlet cooling channel 306 is fluidly coupled with the outlet cooling channel 302 via a passageway 330. Additionally, the first inlet cooling channel 306 and the outlet cooling channel 302 are fluidly separate from the trailing edge chamber 308.

In one or more embodiments, the fluidly coupled first inlet cooling channel 306 and the outlet cooling channel 302 may be referred to as an outer cooling circuit, such that the outer cooling circuit directs some coolant outside of and around the second inlet cooling channel 304. Optionally, flow of the coolant within the outer cooling circuit may be reversed. For example, a portion of the coolant may be directed into the cooling channel 302 that may be fluidly coupled with the cooling channel 306 that may direct the portion of the coolant in a direction away from the trailing edge chamber 308. For example, the coolant may move in a direction along the inside of the pressure side 114 of the airfoil 100 toward the trailing edge 120, and away from the trailing edge 120 along the inside of the suction side 116. Alternatively, the coolant may move in a direction along the inside of the suction side 116 toward the trailing edge 120, and away from the trailing edge 120 along the inside of the pressure side 114 of the airfoil 100.

The second inlet cooling channel 304 is fluidly separate from the first inlet cooling channel 306 and the outlet cooling channel 302. Additionally, the second inlet cooling channel 304 is fluidly coupled with the trailing edge chamber 308. For example, as illustrated in FIG. 4, the second inlet cooling channel 304 directs at least a portion of the coolant from the coolant chamber 314 in the direction 324 generally toward the trailing edge chamber 308 and toward an inner surface 310 of the trailing edge chamber 308. The second inlet cooling channel 304 directs some of the coolant toward the inner surface 310 to impinge on the inner surface 310 of the trailing edge chamber 308. For example, the second inlet cooling channel 304 directs at least some coolant toward the inner surface 310 to reduce a temperature of the inner surface 310 of the trailing edge chamber 308.

In one or more embodiments, the first inlet cooling channel 306 may be referred to as a first outer cooling channel 306, the outlet cooling channel 302 may be referred to as a second outer cooling channel 302, and the second inlet cooling channel 304 may be referred to as a middle cooling channel 304. For example, the first outer cooling channel 306 is disposed between the middle cooling channel 304 and the pressure side 114 of the airfoil 100. Additionally, the second outer cooling channel 302 is disposed between the middle cooling channel 304 and the suction side 116 of the airfoil 100.

The first outer cooling channel 306 directs a portion of the coolant toward the trailing edge 120 of the airfoil 100 in the direction 326, and the second outer cooling channel 302 directs the portion of the coolant away from the trailing edge 120 of the airfoil 100 in the direction 322. For example, the first outer cooling channel 306 directs a portion of the coolant along a pressure side inner surface 318 of the airfoil 100, and the second outer cooling channel 302 directs a portion of the coolant along a suction side inner surface 316 of the airfoil 100. In the illustrated embodiment of FIG. 3, the first outer cooling channel 306 directs the portion of the coolant in the direction 326 along the pressure side inner surface 318 toward the trailing edge chamber 308, and the second outer cooling channel 302 directs the portion of the coolant in the direction 322 along the suction side inner surface 316 away from the trailing edge chamber 308. Optionally, the direction of the flow of the coolant within the outer cooling circuit may change, such that coolant is directed toward the trailing edge chamber 308 via the second outer cooling channel 302, and coolant is directed away from the trailing edge chamber 308 via the first outer cooling channel 306.

In one or more embodiments, the second outer cooling channel 302 (e.g., the outlet cooling channel) may be shaped and/or sized to control a pressure of the coolant within the second outer cooling channel 302. For example, the second outer cooling channel 302 may have a shape and/or size relative to the shape and/or size of the first outer cooling channel 306 to promote the flow of the coolant from the first outer cooling channel 306 toward the second outer cooling channel 302 via the passageway 330.

The first and second outer cooling channels 306, 302 direct some of the coolant around the middle cooling channel 304. For example, the outer cooling circuit (e.g., the first and second outer cooling channels) may be a buffer, barrier, or the like, between the pressure and suction sides 114, 116 of the airfoil 100 and the middle cooling channel 304.

Additionally, the first and second outer cooling channels 306, 302 may thermally isolate and/or separate the middle cooling channel 304 from one or more exterior surfaces of the airfoil 100. For example, operating the turbine engine increases a temperature outside of the airfoil 100 and subjects the pressure side 114, the suction side 116, and the trailing edge 120 to increased operating temperatures. The first outer cooling channel 306 thermally isolates or separates the middle cooling channel 304 from the exterior surface of the pressure side 114 of the airfoil 100, and the second outer cooling channel 302 thermally isolates or separates the middle cooling channel 304 from the exterior surface of the suction side 116 of the airfoil 100.

Thermally isolating and/or separating the middle cooling channel 304 from the increased temperatures outside of the pressure and suction sides 114, 116 of the airfoil 100 may reduce an amount of heat that may be subjected to the coolant that moves within the middle cooling channel 304. Additionally, thermally separating the middle cooling channel 304 from the pressure and suction sides 114, 116 may reduce an amount of heat transfer between the increased or higher temperatures outside of the airfoil 100 and relative to the lower or cooler temperatures of the coolant that moves within the middle cooling channel 304. Reducing an amount of heat transfer between the higher temperatures outside the airfoil 100 and the lower or cooler temperatures of the coolant within the middle cooling channel 304 reduces an amount of temperature that the coolant within the middle cooling channel 304 may increase. Reducing an amount of temperature that the coolant within the middle cooling channel 304 allows for a cooler coolant to impinge on the inner surface 310 of the trailing edge chamber 308 relative to the cooling assembly 300 not including the outer cooling circuit of the first and second outer cooling channels 306, 302.

In one or more embodiments, the trailing edge chamber 308 may be a single chamber that may extend any distance between the first end 134 and the second end 136 of the airfoil 100 along the radial length 124 of the airfoil 100. Optionally, the cooling assembly 300 may include plural trailing edge chambers (not shown), that may have any shape and/or size, and may be disposed at one or more different positions between the first and second ends 134, 136 along the radial length 124 of the airfoil 100.

Additionally or alternatively, the cooling assembly 300 may include any number of middle cooling channels (not shown) that may be fluidly coupled with one or more other middle cooling channels, the coolant chamber, and one or more of the trailing edge chambers along the radial length 124 of the airfoil 100 in any combination. Additionally or alternatively, each of the middle cooling channels may be separated from the pressure and suctions sides 114, 116 by first and second outer cooling channels that may direct a portion of the coolant around each of the middle cooling channels.

In one or more embodiments, the cooling assembly 300 may also include one or more suction side conduits 332 that may be passageways between the outlet cooling channel 302 and the suction side 116 of the airfoil 100. For example, the suction side conduits 332 may extend between the suction side inner surface 316 inside the outlet cooling channel 302 and an exterior surface of the suction side 116 of the airfoil 100. The one or more suction side conduits 332 may direct a portion of the coolant out of the outlet cooling channel 302 in a direction 342. For example, the portion of the coolant directed out of the suction side conduits 332 may provide a film or cooling surface on the exterior surface of the suction side 116 of the airfoil 100. Additionally, the one or more suction side conduits 332 may be shaped, sized, and positioned, to control a pressure of the portion of the coolant that may be directed out of the airfoil 100 via the suction side conduits 332.

Optionally, the cooling assembly 300 may include one or more pressure side conduits 336 that may be passageways between the first inlet cooling channel 306 and the pressure side 114 of the airfoil 100. The one or more pressure side conduits 336 may extend between the pressure side inner surface 318 and an exterior surface of the pressure side 114 of the airfoil 100 to fluidly couple the first inlet cooling channel 306 with the exterior of the airfoil 100. The pressure side conduits 336 may direct a portion of the coolant out of the first inlet cooling channel 306 in a direction 346 toward the exterior surface of the pressure side 114 of the airfoil 100. For example, the portion of the coolant directed out of the pressure side conduits 336 may provide a film or cooling surface on the exterior surface of the pressure side 114 of the airfoil 100. Additionally, the pressure side conduits 336 may be shaped, sized, and positioned to control a pressure of the portion of the coolant that may be directed out of the airfoil 100 via the pressure side conduits 336.

Figure 5:
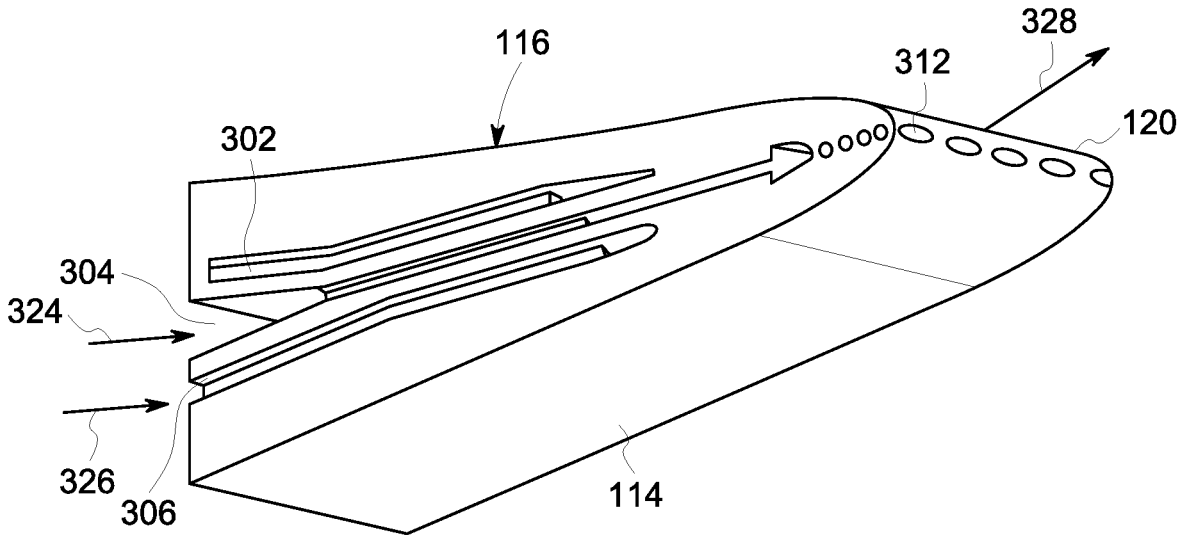
FIG. 5 illustrates a rear perspective view of the cooling assembly shown in FIG. 3.
Figure 6:
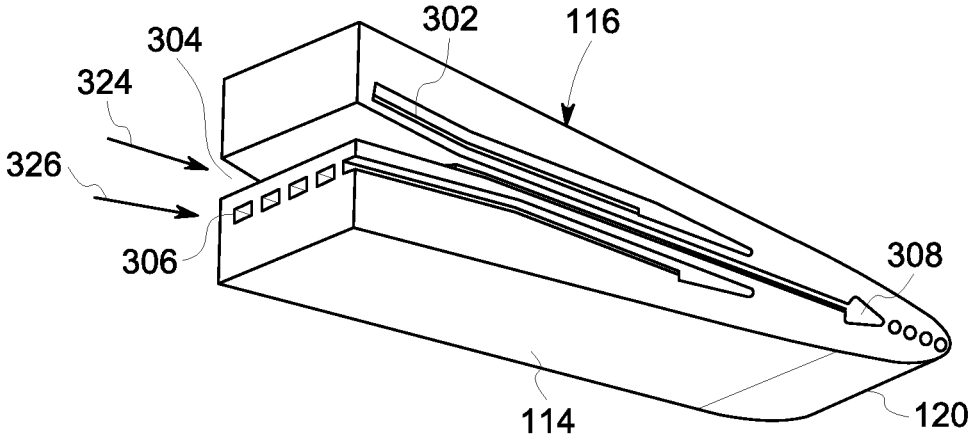
FIG. 6 illustrates front perspective view of the cooling assembly shown in FIG. 3.

FIG. 5 illustrates a rear perspective view of the cooling assembly 300 at the second position 204 along the radial length 124. FIG. 6 illustrates front perspective view of the cooling assembly 300 at the second position 204 along the radial length 124. The cooling assembly 300 includes plural trailing edge conduits 312 that are fluidly coupled with the trailing edge chamber 308 and direct a portion of the coolant out of the trailing edge chamber 308 in a direction 328. In the illustrated embodiment of FIG. 5, the cooling assembly 300 includes 5 trailing edge conduits 312, but may include any number of conduits. For example, the cooling assembly 300 may include any number of trailing edge conduits disposed at any position along the radial length 124 of the airfoil 100.

Additionally, the trailing edge conduits 312 illustrated in FIG. 5 are substantially uniform in shape and size, but alternatively each conduit may have any unique shape and/or size relative to each other trailing edge conduit 312. Optionally, the conduits 312 may extend in one or more different directions between the trailing edge chamber 308 and the trailing edge 120 of the airfoil 100. For example, the trailing edge conduits 312 may be passageways between the trailing edge chamber 308 and the trailing edge 120 of the airfoil 100 and may extend at any angle relative to the direction 324 of the second inlet cooling channel 304 directing the coolant toward the trailing edge chamber 308. For example, the angle of the trailing edge conduits 312 may be configured to control a direction of the coolant that is directed out of the trailing edge chamber 308 to one or more target areas, surfaces, regions, or the like, proximate the trailing edge 120 of the airfoil 100.

As illustrated in FIG. 6, the cooling assembly 300 may include plural first inlet cooling channels 306 that may be separated from each other by plural walls. The plural first inlet cooling channel 306 may each be fluidly coupled with a single outlet cooling channel 302 via one or more passageways (not shown in FIG. 6). Optionally, the cooling assembly 300 may also include plural outlet cooling channels. Each of the outlet cooling channels may be fluidly coupled with a single first inlet cooling channel. Optionally, each of the outlet cooling channels may be fluidly coupled with any number of the plural first inlet cooling channels. For example, one or more passageways may fluidly couple one or more first inlet cooling channels with one or more of the outlet cooling channels in any combination.

In one or more embodiments, one or more cooling channels, chambers, passageways, conduits, or the like, of the cooling assembly 300 may be manufactured additively which may allow the cooling channels, chambers, passageways, or the like, of the cooling assembly 300 to have any three-dimensional shapes and/or multi-domain cooling techniques inside the airfoil 100. As one example, additive manufacturing can involve joining or solidifying material under computer control to create a three-dimensional object, such as by adding liquid molecules or fusing powder grains with each other. Examples of additive manufacturing include three-dimensional (3D) printing, rapid prototyping (RP), direct digital manufacturing (DDM), selective laser melting (SLM), electron beam melting (EBM), direct metal laser melting (DMLM), or the like. Alternatively, the cooling assembly 300 can be formed in another manner.

Figure 7:
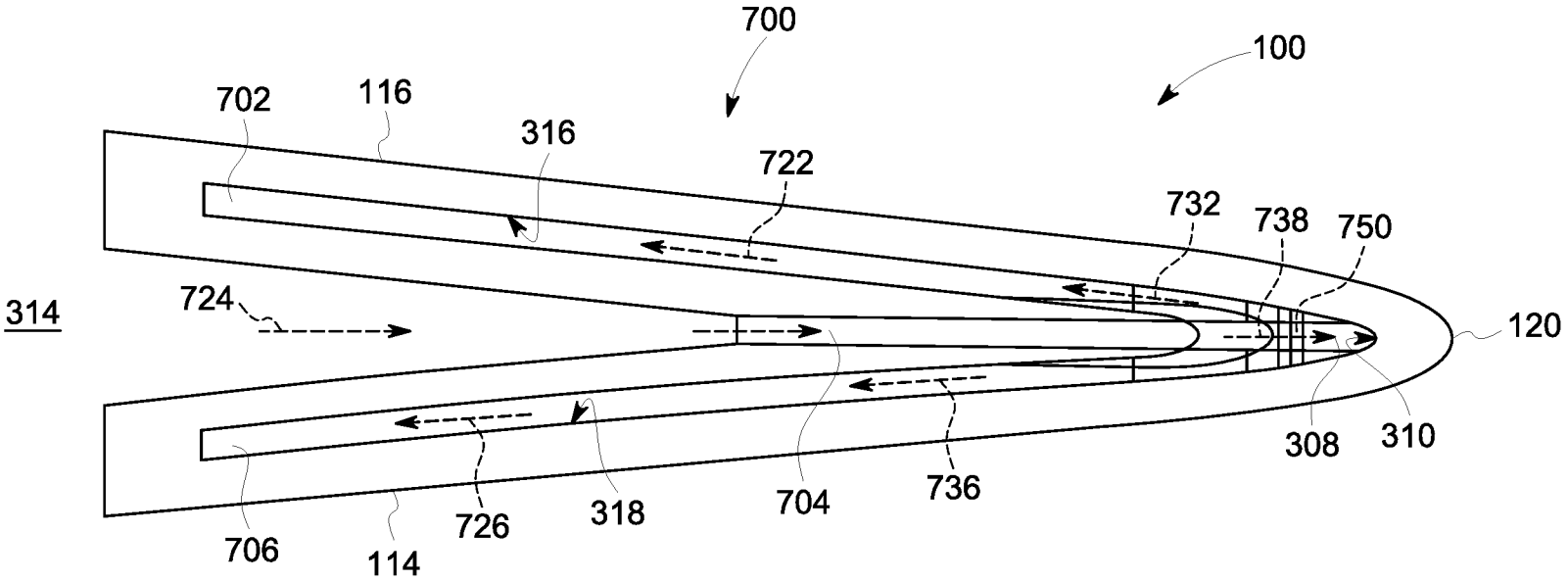
FIG. 7 illustrates a cross-sectional view of a cooling assembly in accordance with one embodiment.
Figure 8:
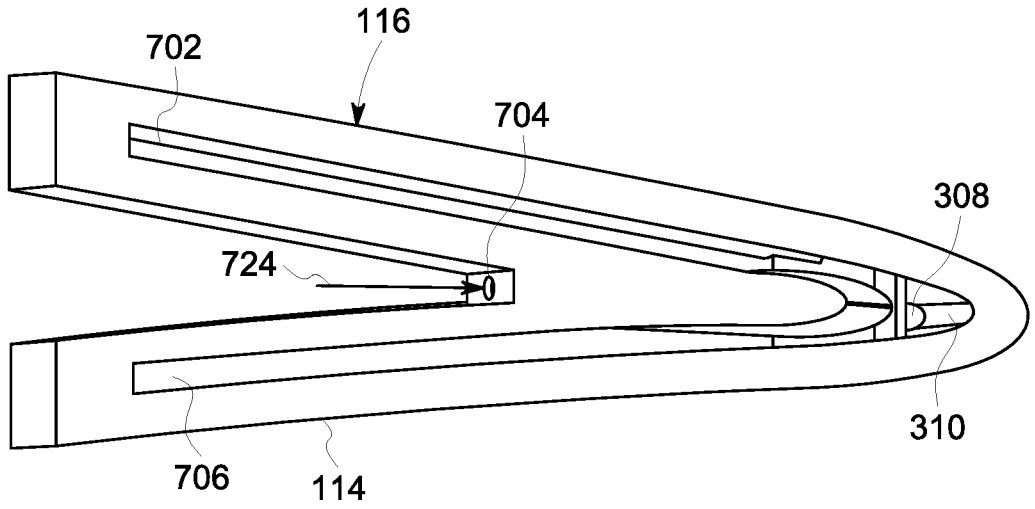
FIG. 8 illustrates a front perspective view of the cooling assembly shown in FIG. 7.
Figure 9:
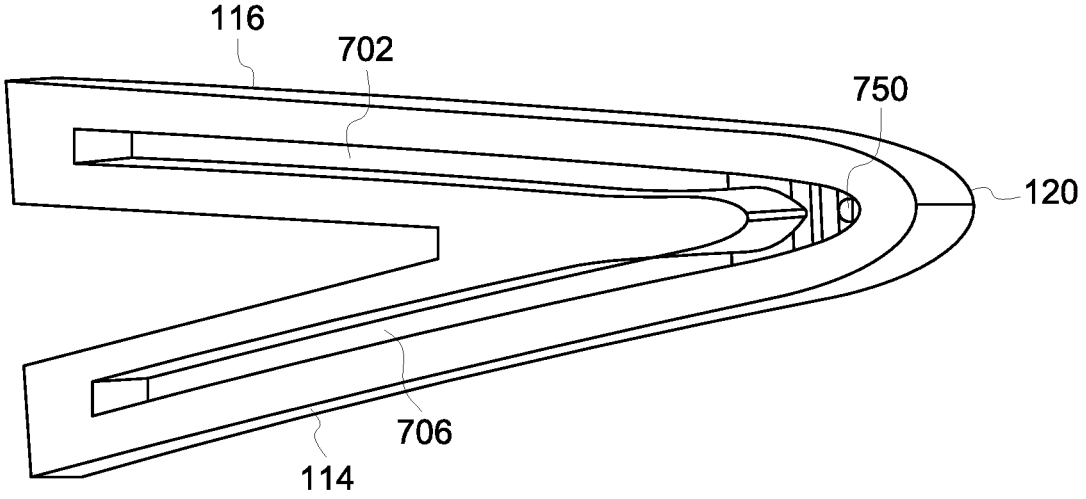
FIG. 9 illustrates a rear perspective view of the cooling assembly shown in FIG. 7.

FIG. 7 illustrates a cross-sectional view of a cooling assembly 700 in accordance with one embodiment. FIG. 8 illustrates a front perspective view of the cooling assembly 700. FIG. 9 illustrates a rear perspective view of the cooling assembly 700. The cooling assembly 700 may also be referred to as a trailing edge cooling assembly such that the cooling assembly 700 includes plural cooling channels that may direct coolant in one or more different directions within and/or outside of the trailing edge 120 of the airfoil 100 to reduce a temperature of the trailing edge 120 of the airfoil 100.

Like the cooling assembly illustrated in FIGS. 3 through 6, the cooling assembly 700 includes plural cooling channels that may direct coolant from the coolant chamber 314 in one or more directions within the airfoil 100 proximate the trailing edge 120 of the airfoil 100. However, the cooling assembly 700 may differ from the cooling assembly 300 by having an inlet cooling channel fluidly coupled with the trailing edge chamber 308 and two or more different outlet cooling channels.

An inlet cooling channel 704 may direct a portion of the coolant in a direction 724 toward the trailing edge chamber 308. A first outlet cooling channel 702 may be fluidly coupled with the inlet cooling channel 704 and may direct a portion of the coolant in a direction 722 away from the trailing edge chamber 308 and away from the trailing edge 120 of the airfoil 100. A second outlet cooling channel 706 may be fluidly coupled with the inlet cooling channel 704 and may direct a portion of the coolant in a different direction 726 away from the trailing edge chamber 308 and away from the trailing edge 120 of the airfoil 100. For example, the cooling circuit of the cooling assembly 700 may be a one-flow circuit, such that all of the coolant is directed toward the trailing edge chamber 308 via the inlet cooling channel 704, and at least portions of the coolant exits the cooling assembly 700 via the first and second outlet cooling channels 702, 706.

Additionally, the inlet cooling channel 704 may also be referred to as a middle cooling channel, and the first and second outlet cooling channels 702, 706 may be referred to as first and second outer cooling channels, respectively. For example, the first outer cooling channel 702 may be disposed between the middle cooling channel 704 and the suction side 116 of the airfoil 100, and the second outer cooling channel 706 may be disposed between the middle cooling channel 704 and the pressure side 114 of the airfoil 100. For example, the first and second outer cooling channels 702, 706 may be a thermal buffer or barrier for the middle cooling channel 704 from the suction and pressure sides 116, 114 of the airfoil 100.

The middle cooling channel 704 may direct coolant from the coolant chamber 314 toward the trailing edge chamber 308. A first portion 732 of the coolant may be directed along the first outer cooling channel 702, a second portion 736 may be directed along the second outer cooling channel 706, and a third portion 738 may be directed to the trailing edge chamber 308 via a conduit 750 that fluidly couples the middle cooling channel 704 with the trailing edge chamber 308. For example, the first portion 732 of the coolant may exchange heat with the higher or greater temperature outside of the suction side 116 of the airfoil 100, and the second portion 736 of the coolant may exchange heat with the higher or greater temperature outside of the pressure side 114 of the airfoil 100. The resulting higher temperature first and second portions 732, 736 may be directed to the coolant chamber 314 and/or to a different coolant chamber (not shown) and away from the trailing edge 120 of the airfoil 100.

The first portion 732 of the coolant may have a temperature that is about the same as a temperature of the coolant of the second portion 736. Additionally, the first and second portions 732, 736 of the coolant may each have a temperature that is greater than a temperature of the coolant within the middle cooling channel 704. For example, the first and second portions 732, 736 of the coolant may receive thermal energy in the form of transferred heat from the greater or higher temperatures outside the suction and pressure sides 116, 114 of the airfoil 100, respectively, that may increase the temperatures of the first and second portions 732, 736 of the coolant. The coolant that moves within the middle cooling channel 704 and the third portion 738 that is directed to the trailing edge chamber 308 to impinge on the inner surface 310 of the trailing edge chamber 308 has a temperature that is less than (i.e., is cooler than) a temperature of the first portion 732 of the coolant, and is less than (i.e., is cooler than) a temperature of the second portion 736 of the coolant.

Additionally, the first and second outer cooling channels 702, 706 may be disposed between the middle cooling channel 704 and the suction and pressure sides 116, 114 of the airfoil 100, respectively, to reduce an amount of thermal energy that may transfer between the greater temperatures outside the airfoil 100 and the reduced temperatures of the coolant within the middle cooling channel 704. Additionally or alternatively, the cooling assembly 700 may also include a second cooling circuit that may be disposed between the pressure and suction sides 114, 116 of the airfoil 100 and the first and second outer cooling channels 702, 706. For example, the first cooling circuit (e.g., the first and second outer cooling channels 702, 706) may be a thermal buffer or barrier between the second cooling circuit and the middle cooling channel, and the second cooling circuit may be a thermal buffer or barrier between the first cooling circuit and the exterior surfaces of the airfoil 100.

In one or more embodiments, the coolant chamber 314 may cool the first and second portions 732, 736 of the coolant received via the first and second outer cooling channels 702, 706, respectively, and recycle the cooler recycled coolant into the middle cooling channel 704 (not shown). Optionally, first and second portions 732, 736 of the coolant may be directed toward one or more other cooling systems within the airfoil 100 disposed at another position within the airfoil 100 (e.g., proximate the leading edge 112 of the airfoil). Optionally, the first and second portions 732, 736 may be received by the coolant chamber 314 and directed out of the airfoil via one or more conduits or passages fluidly coupling the coolant chamber 314 with one or more exterior surfaces of the airfoil 100.

The third portion 738, or a portion thereof, may impinge on the inner surface 310 of the trailing edge chamber. Optionally, the cooling assembly 700 may include one or more trailing edge conduits (not shown) that may be passages that fluidly couple the trailing edge chamber with an exterior surface of the airfoil 100 at, or proximate to, the trailing edge 120 of the airfoil 100.

In one or more embodiments, the cooling assembly 700 may include one or more suction side conduits (not shown) that fluidly couple the first outer cooling channel 702 with an exterior surface of the airfoil 100 at the suction side 116 of the airfoil 100. A portion of the coolant may be directed out of the first outer cooling channel 702 and along the exterior surface of the suction side 116 of the airfoil 100. Additionally or alternatively, the cooling assembly 700 may include one or more pressure side conduits (not shown) that may fluidly couple the second outer cooling channel 706 with an exterior surface of the airfoil 100 at the pressure side 114 of the airfoil 100. A portion of the coolant may be directed out of the second outer cooling channel 706 and along the exterior surface of the pressure side 114 of the airfoil 100.

Figure 10:
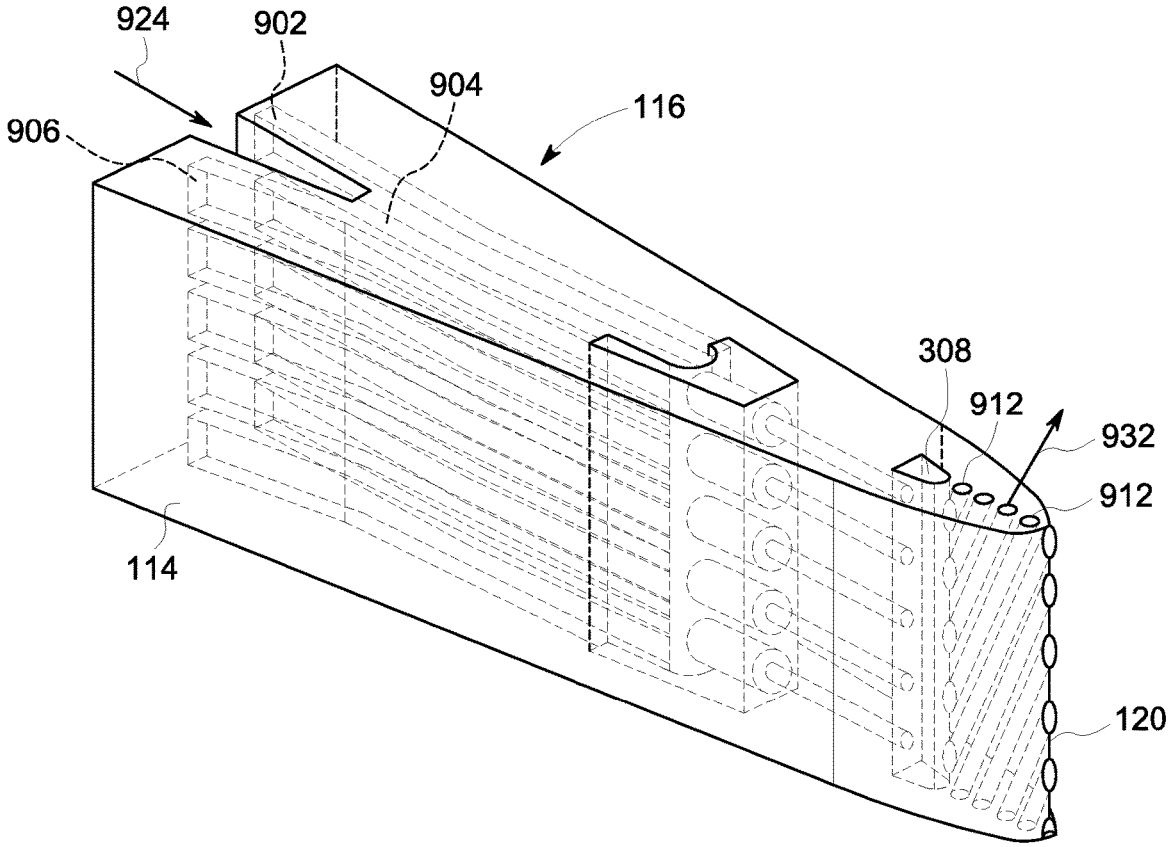
FIG. 10 illustrates a cross-sectional view of a cooling assembly in accordance with one embodiment.

FIG. 10 illustrates a cross-sectional view of a cooling assembly 900 in accordance with one embodiment. Similar to the cooling assemblies illustrated in FIGS. 3 through 9, the cooling assembly 900 includes an inlet cooling channel 904 that directs some coolant from a coolant chamber (not shown) toward the trailing edge chamber 308. The inlet cooling channel 904 may be referred to as a middle cooling channel, such that the middle cooling channel 904 is disposed between another inlet cooling channel 906 and an outlet cooling channel 902. In the illustrated embodiment of FIG. 9, the cooling channels 902, 906 are fluidly coupled with each other, and are fluidly separate from the middle cooling channel 904 and the trailing edge chamber 308. Optionally, the cooling channels 902, 904, 906, and the trailing edge chamber 308, may be fluidly coupled with or fluidly separate from each other in any combination.

The cooling assembly 900 also includes plural trailing edge conduits 912 that direct coolant out of the trailing edge chamber 308 toward an exterior surface of the airfoil 100 proximate the trailing edge 120 of the airfoil 100. The trailing edge conduits 912 direct a portion of coolant out of the trailing edge chamber 308 in one or more directions 932. For example, the trailing edge conduits 912 direct coolant out of the airfoil 100 at an angle relative to the direction 924 the inlet cooling channel 904 directs the coolant toward the trailing edge chamber 308. Additionally, the trailing edge conduits 912 may be shaped and/or sized to direct the coolant out of the trailing edge chamber 308 at a high angle relative to the trailing edge 120 of the airfoil 100. The directions 932 may be at any angle relative to the direction 924. Optionally, the directions 932 may be substantially parallel to the direction 924. Optionally, each of the plural trailing edge conduits 912 may direct coolant in one or more different directions relative to each other trailing edge conduit 912.

In one or more embodiments, one or more inlet cooling channels and/or one or more outlet cooling channels of the cooling assemblies 300, 700, 900 may also include one or more passages that may fluidly couple the inlet and outlet cooling channels with each other in any combination. Optionally, one or more the cooling channels may also include one or more structures or features, or may be shaped and/or sized to promote increased turbulence of the coolant within the cooling channels, that may change a pressure of the coolant within the cooling channels to control a direction of movement of the coolant within the cooling channels, that may promote the transfer of thermal energy (i.e., heat transfer) between one or more exterior surfaces of the airfoil (i.e., proximate the trailing edge of the airfoil) and the coolant within the cooling channels to reduce a temperature of the trailing edge 120 of the airfoil 100, or the like.

Figure 11:
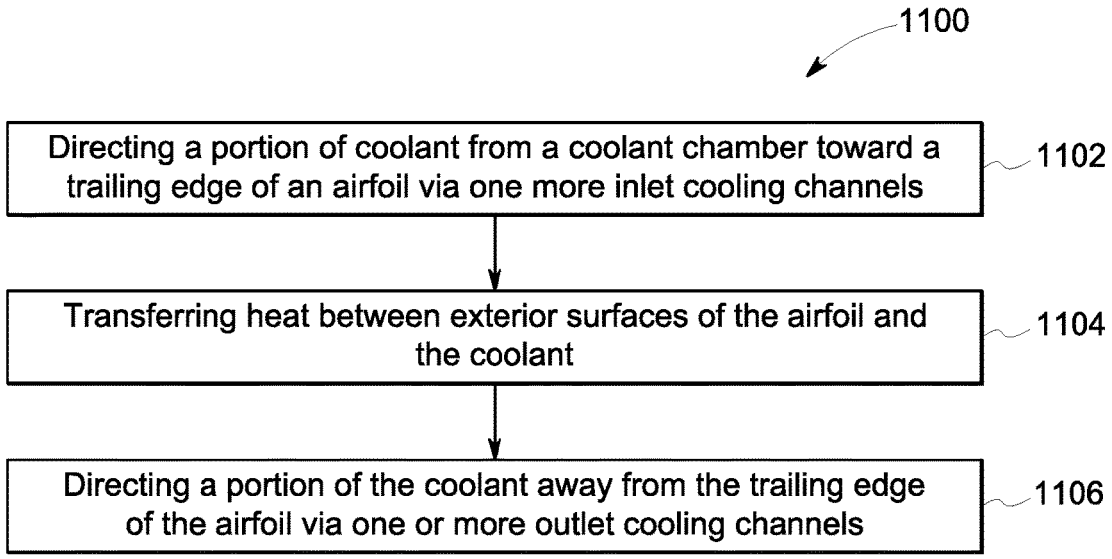
FIG. 11 illustrates a flowchart of a method for cooling a trailing edge of an airfoil in accordance with one embodiment.

FIG. 11 illustrates a flowchart of a method 1100 for cooling a trailing edge of an airfoil in accordance with one embodiment. A cooling assembly may be additively manufactured or formed within an airfoil, proximate the trailing edge of the airfoil. At least one coolant chamber may be fluidly coupled with one or more inlet cooling channels and one or more outlet cooling channels. At least one inlet cooling channel is fluidly coupled with at least one outlet cooling channel. Additionally, at least one inlet cooling channel may be fluidly coupled with a trailing edge chamber.

At 1102, a portion of coolant is directed out of the coolant chamber and in one or more directions toward the trailing edge of the airfoil within the airfoil via at least one of inlet cooling channels. At least a portion of the coolant may be directed toward one of the outlet cooling channels, and at least another portion of the coolant may be directed toward an internal surface of a trailing edge chamber. As one example, the cooling assembly may include a first outer cooling channel (e.g., cooling channel 306) that may direct coolant toward the trailing edge of the airfoil. The first outer cooling channel may be fluidly coupled with the coolant chamber and a second outer cooling channel. The second outer cooling channel may be an outlet cooling channel that directs coolant away from the trailing edge of the airfoil. A middle cooling channel may direct some coolant from the coolant chamber toward a training edge chamber. For example, the middle cooling channel may be fluidly separate from the first and second outer cooling channels, and may be fluidly coupled with the coolant chamber and the trailing edge chamber. The middle cooling channel may be disposed between the first and second outer cooling channels, the first outer cooling channel may be disposed between the pressure side of the airfoil and the middle cooling channel, and the second outer cooling channel may be disposed between the suction side of the airfoil and the middle cooling channel.

As another example, the middle cooling channel may be an inlet cooling channel, and the first and second outer cooling channels may be outlet cooling channels. The middle cooling channel may be fluidly coupled with the first outer cooling channel, the second outer cooling channel, and the trailing edge chamber.

At 1104, a temperature of the portion of the coolant is increased by the transfer of heat from an exterior of the airfoil to the coolant within the one or more cooling channels of the cooling assembly. As one example, the temperature of the coolant within the first and second outer cooling channels increases in response to the transfer of heat from outside of the airfoil to the coolant within the first and second outer cooling channels. As one example, the first outer cooling channel is an inlet cooling channel and the second outer cooling channel is an outlet cooling channel and is fluidly coupled with the first outer cooling channel. A temperature of the coolant in the second outer cooling channel (e.g., the outlet cooling channel) is greater than a temperature of the coolant in the first outer cooling channel (e.g., the inlet cooling channel). For example, the coolant within the first outer cooling channel receives heat transferred from the exterior of the airfoil. The coolant moves from the first outer cooling channel to the second outer cooling channel. The coolant subsequently receives move heat transferred from the exterior of the airfoil.

As another example, t temperature of the coolant in the first outer cooling channel may be about the same as a temperature of the coolant in the second outer cooling channel. Additionally, a temperature of the coolant in the middle cooling channel may be less than (e.g., cooler than) a temperature of the coolant in the first and second outer cooling channels.

At 1106, the increased temperature of the portion of the coolant within the outlet cooling channel is directed away from the trailing edge of the airfoil via the one or more outlet cooling channels. Additionally, the increased temperature of the portion of the coolant may be directed out of the airfoil via one or more trailing edge conduits fluidly coupling the trailing edge chamber with an exterior surface of the airfoil. Additionally or alternatively, a portion of the coolant may be directed out of the trailing edge chamber and/or one or more of the outer cooling channels via pressure side conduits and/or suction side conduits.

In one or more embodiments, the hotter coolant may be redirected back into a coolant chamber (e.g., a different coolant chamber) via one or more outlet cooling channels, and may be recycled within the cooling assembly. Optionally, the hotter coolant may be directed out of the airfoil 100.

In one or more embodiments of the subject matter described herein, a cooling assembly includes a coolant chamber disposed inside an airfoil of a turbine assembly. The coolant chamber directs coolant inside the airfoil of the turbine assembly. The airfoil extends between a leading edge of the airfoil and a trailing edge of the airfoil along an axial length of the airfoil. One or more inlet cooling channels are fluidly coupled with the coolant chamber and direct the coolant in a direction toward a trailing edge chamber of the airfoil. The trailing edge chamber is fluidly coupled with at least one of the one or more inlet cooling channels. The trailing edge chamber is disposed at the trailing edge of the airfoil and includes an inner surface. The one or more inlet cooling channels direct at least a portion of the coolant in a direction toward the inner surface of the trailing edge chamber. One or more outlet cooling channels direct at least a portion of the coolant in one or more directions away from the trailing edge chamber of the airfoil.

Optionally, at least one of the one or more inlet cooling channels is disposed between at least one of the one or more outlet cooling channels and one of another outlet cooling channel or another inlet cooling channel.

Optionally, at least one of the one or more inlet cooing channels is fluidly coupled with at least one of the one or more outlet cooling channels.

Optionally, the one or more outlet cooling channels are sized to control a pressure of the coolant within the one or more outlet cooling channels.

Optionally, the cooling assembly may include one or more suction side conduits fluidly coupled with a suction side inner surface of the airfoil within at least one of the one or more inlet cooling channels or at least one of the one or more outlet cooling channels. The one or more suction side conduits direct a portion of the coolant out of a suction side of the airfoil.

Optionally, the one or more suction side conduits may be sized to control a pressure of the portion of the coolant directed toward the suction side of the airfoil.

Optionally, the cooling assembly may include one or more pressure side conduits fluidly coupled with a pressure side inner surface of the airfoil within at least one of the one or more inlet cooling channels or at least one of the one or more outlet cooling channels. The one or more pressure side conduits direct a portion of the coolant toward a pressure side of the airfoil.

Optionally, the one or more pressure side conduits are sized to control a pressure of the portion of the coolant directed toward the pressure side of the airfoil.

Optionally, at least one of the one or more inlet cooling channels is fluidly coupled with one of the one or more outlet cooling channels and is fluidly separate from the trailing edge chamber.

Optionally, the coolant of the one or more inlet cooling channels transfers heat with the coolant of the one or more outlet cooling channels.

Optionally, the trailing edge chamber is fluidly coupled with one or more trailing edge conduits. The one or more trailing edge conduits direct at least a portion of the coolant out of the trailing edge chamber and out of the airfoil at an angle relative to the direction the one or more inlet cooling channels directs the coolant toward the trailing edge chamber.

Optionally, one of the one or more inlet cooling channels is a first outer cooling channel, and at least one of the one or more outlet cooling channels is a second outer cooling channel. The first outer cooling channel is fluidly coupled with the second outer cooling channel. The first outer cooling channel and the second outer cooling channel are fluidly separate from the trailing edge chamber.

Optionally, one of the one or more inlet cooling channels is a middle cooling channel. One of the one or more outlet cooling channels is a first outer cooling channel, and another of the one or more outlet cooling channels is a second outer cooling channel. The middle cooling channel is fluidly coupled with the trailing edge chamber, the first outer cooling channel, and the second outer cooling channel.

Optionally, the middle cooling channel directs the coolant in a direction toward the trailing edge chamber, the first outer cooling channel directs at least a portion of the coolant in a direction away from the trailing edge chamber, and the second outer cooling channel directs at least a portion of the coolant in a direction away from the trailing edge chamber.

Optionally, at least one of the one or more inlet cooling channels or the one or more outlet cooling channels is disposed along a suction side of the airfoil and is configured to reduce an amount of heat transfer from a gas outside of the suction side of the airfoil to a portion of the coolant inside the airfoil, and at least one of the one or more inlet cooling channels or the one or more outlet cooling channels is disposed along the pressure side of the airfoil and is configured to reduce an amount of heat transfer from a gas outside of the pressure side of the airfoil to a portion of the coolant inside the airfoil.

In one or more embodiments of the subject matter described herein, a cooling assembly includes one or more coolant chambers disposed inside an airfoil of a turbine assembly. The one or more coolant chambers direct coolant inside the airfoil of the turbine assembly. The airfoil extends between a leading edge and a trailing edge along an axial length of the airfoil. One or more inlet cooling channels are fluidly coupled with at least one of the one or more coolant chambers and direct the coolant in a direction toward a trailing edge chamber of the airfoil. The trailing edge chamber is disposed at the trailing edge of the airfoil and includes an inner surface. The one or more inlet cooling channels direct at least a portion of the coolant in a direction toward the inner surface of the trailing edge chamber. One or more outlet cooling channels direct at least a portion of the coolant in one or more directions away from the trailing edge chamber of the airfoil. At least one of the one or more inlet cooling channels or the one or more outlet cooling channels is disposed along a suction side of the airfoil within the airfoil, and at least one of the one or more inlet cooling channels or the one or more outlet cooling channels is disposed along a pressure side of the airfoil. The at least one of the one or more inlet cooling channels or the one or more outlet cooling channels disposed along the suction side of the airfoil reduces an amount of heat transfer from a gas outside of the suction side of the airfoil to a portion of the coolant inside the airfoil, and the at least one of the one or more inlet cooling channels or the one or more outlet cooling channels disposed along the pressure side of the airfoil reduces an amount of heat transfer from a gas outside of the pressure side of the airfoil to a portion of the coolant inside the airfoil.

Optionally, the one or more outlet cooling channels are sized to control a pressure of the coolant within the one or more outlet cooling channels.

Optionally, the trailing edge chamber is fluidly coupled with one or more trailing edge conduits that direct at least a portion of the coolant out of the trailing edge chamber and out of the airfoil at an angle relative to the direction the one or more inlet cooling channels directs the coolant toward the trailing edge chamber.

Optionally, the cooling assembly may include one or more suction side conduits fluidly coupled with a suction side inner surface of the airfoil within at least one of the one or more inlet cooling channels or at least one of the one or more outlet cooling channels. The one or more suction side conduits direct a portion of the coolant out of the suction side of the airfoil.

Optionally, the cooling assembly may include one or more pressure side conduits fluidly coupled with a pressure side inner surface of the airfoil within at least one of the one or more inlet cooling channels or at least one of the one or more outlet cooling channels. The one or more pressure side conduits direct a portion of the coolant out of a pressure side of the airfoil.

Optionally, one of the one or more inlet cooling channels is a first outer cooling channel, and at least one of the one or more outlet cooling channels is a second outer cooling channel. The first outer cooling channel is fluidly coupled with the second outer cooling channel. The first outer cooling channel and the second outer cooling channel are fluidly separate from the trailing edge chamber.

Optionally, one of the one or more inlet cooling channels is a middle cooling channel. One of the one or more outlet cooling channels is a first outer cooling channel, and another of the one or more outlet cooling channels is a second outer cooling channel. The middle cooling channel is fluidly coupled with the trailing edge chamber, the first outer cooling channel, and the second outer cooling channel.

Optionally, the middle cooling channel directs the coolant in a direction toward the trailing edge chamber. The first outer cooling channel directs at least a portion of the coolant in a direction away from the trailing edge chamber, and the second outer cooling channel directs at least a portion of the coolant in a direction away from the trailing edge chamber.

In one or more embodiments of the subject matter described herein, a cooling assembly includes a coolant chamber disposed inside an airfoil of a turbine assembly. The coolant chamber directs coolant inside the airfoil of the turbine assembly. The airfoil extends between a leading edge of the airfoil and a trailing edge of the airfoil along an axial length of the airfoil. An inlet cooling channel is fluidly coupled with the coolant chamber and directs the coolant in a direction toward a trailing edge chamber of the airfoil. The trailing edge chamber is fluidly coupled with the inlet cooling channel. The trailing edge chamber is disposed at the trailing edge of the airfoil and includes an inner surface. The trailing edge chamber is fluidly coupled with one or more trailing edge conduits that direct at least a portion of the coolant out of the trailing edge chamber and out of the airfoil. One or more outlet cooling channels direct at least a portion of the coolant in one or more directions away from the trailing edge chamber of the airfoil. At least one of the inlet cooling channel or the one or more outlet cooling channels is disposed along a suction side of the airfoil within the airfoil and fluidly coupled with the suction side of the airfoil via one or more suction side conduits. The one or more suction side conduits direct a portion of the coolant out of the at least one of the inlet cooling channel or the one or more outlet cooling channels toward the suction side of the airfoil. At least one of the inlet cooling channel or the one or more outlet cooling channels is disposed along a pressure side of the airfoil within the airfoil and fluidly coupled with the pressure side of the airfoil via one or more pressure side conduits. The one or more pressure side conduits direct a portion of the coolant out of the at least one of the inlet cooling channel or the one or more outlet cooling channels toward the pressure side of the airfoil.

As used herein, an element or step recited in the singular and proceeded with the word "a" or "an" should be understood as not excluding plural of said elements or steps, unless such exclusion is explicitly stated. Furthermore, references to "one embodiment" of the presently described subject matter are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the subject matter set forth herein without departing from its scope. While the dimensions and types of materials described herein are intended to define the parameters of the disclosed subject matter, they are by no means limiting and are exemplary embodiments. Many other embodiments will be apparent to those of skill in the art upon reviewing the above description. The scope of the subject matter described herein should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose several embodiments of the subject matter set forth herein, including the best mode, and also to enable a person of ordinary skill in the art to practice the embodiments of disclosed subject matter, including making and using the devices or systems and performing the methods. The patentable scope of the subject matter described herein is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

What is claimed is:

1. A cooling assembly comprising:

a coolant chamber disposed inside an airfoil of a turbine assembly, the coolant chamber configured to direct coolant inside the airfoil of the turbine assembly, the airfoil including a pressure side and a suction side and extending between a leading edge of the airfoil and a trailing edge of the airfoil along an axial length of the airfoil;

one or more inlet cooling channels extending from the coolant chamber to a passageway, the one or more inlet cooling channels fluidly coupled with the coolant chamber and configured to direct the coolant in a direction toward a trailing edge chamber of the airfoil, the trailing edge chamber disposed at the trailing edge of the airfoil and including an inner surface extending from the pressure side to the suction side, wherein the one or more inlet cooling channels are configured to direct at least a portion of the coolant to impinge on the inner surface of the trailing edge chamber; and one or more outlet cooling channels extending from the passageway to the coolant chamber, the one or more outlet cooling channels configured to direct at least a portion of the coolant in one or more directions away from the trailing edge chamber of the airfoil, wherein at least one of the one or more inlet cooling channels is fluidly coupled with one of the one or more outlet cooling channels, and wherein the at least one of the one or more inlet cooling channels is fluidly separate from the trailing edge chamber.

2. The cooling assembly of claim 1, wherein at least one of the one or more inlet cooling channels is disposed between at least one of the one or more outlet cooling channels and one of another outlet cooling channel or another inlet cooling channel.

3. The cooling assembly of claim 1, wherein at least one of the one or more inlet cooling channels is fluidly coupled with at least one of the one or more outlet cooling channels via the passageway.

4. The cooling assembly of claim 1, further comprising one or more suction side conduits fluidly coupled with a suction side inner surface of the airfoil within at least one of the one or more inlet cooling channels or at least one of the one or more outlet cooling channels, wherein the one or more suction side conduits are configured to direct a portion of the coolant toward the suction side of the airfoil.

5. The cooling assembly of claim 4, wherein the one or more suction side conduits are sized to control a pressure of the portion of the coolant directed toward the suction side of the airfoil.

6. The cooling assembly of claim 1, further comprising one or more pressure side conduits fluidly coupled with a pressure side inner surface of the airfoil within at least one of the one or more inlet cooling channels or at least one of the one or more outlet cooling channels, wherein the one or more pressure side conduits are configured to direct a portion of the coolant toward the pressure side of the airfoil.

7. The cooling assembly of claim 6, wherein the one or more pressure side conduits are sized to control a pressure of the portion of the coolant directed toward the pressure side of the airfoil.

8. The cooling assembly of claim 1, wherein the trailing edge chamber is fluidly coupled with one or more trailing edge conduits, wherein the one or more trailing edge conduits are configured to direct at least a portion of the coolant out of the trailing edge chamber.

9. The cooling assembly of claim 8, wherein the one or more trailing edge conduits are configured to direct at least a portion of the coolant out of the airfoil at an angle relative to the direction the one or more inlet cooling channels direct the coolant toward the trailing edge chamber.

10. The cooling assembly of claim 1, wherein one of the one or more inlet cooling channels is a first outer cooling channel, and at least one of the one or more outlet cooling channels is a second outer cooling channel, wherein the first outer cooling channel is fluidly coupled with the second outer cooling channel.

11. The cooling assembly of claim 1, wherein at least one of the one or more inlet cooling channels or the one or more outlet cooling channels is disposed along the suction side of the airfoil and is configured to reduce an amount of heat transfer from a gas outside of the suction side of the airfoil to a portion of the coolant inside the airfoil, and at least one of the one or more inlet cooling channels or the one or more outlet cooling channels is disposed along the pressure side of the airfoil and is configured to reduce an amount of heat transfer from a gas outside of the pressure side of the airfoil to a portion of the coolant inside the airfoil.

12. The cooling assembly of claim 1, wherein at least two inlet cooling channels extend to the trailing edge chamber and at least two trailing edge conduits extend from the trailing edge chamber.

13. A cooling assembly comprising:

a coolant chamber disposed inside an airfoil of a turbine assembly, the coolant chamber configured to direct coolant inside the airfoil of the turbine assembly, the airfoil including a pressure side and a suction side and extending between a leading edge of the airfoil and a trailing edge of the airfoil along an axial length of the airfoil;

one or more inlet cooling channels fluidly coupled with the coolant chamber and configured to direct the coolant in a direction toward a trailing edge chamber of the airfoil, the trailing edge chamber fluidly coupled with at least one of the one or more inlet cooling channels, the trailing edge chamber disposed at the trailing edge of the airfoil and including an inner surface extending from the pressure side to the suction side, wherein the one or more inlet cooling channels are configured to direct at least a portion of the coolant to impinge on the inner surface of the trailing edge chamber; and one or more outlet cooling channels configured to direct at least a portion of the coolant in one or more directions away from the trailing edge chamber of the airfoil, wherein the one or more inlet cooling channels comprises a first inlet cooling channel and a second inlet cooling channel, the first inlet cooling channel extending from the coolant chamber to a passageway on a first side of the second inlet cooling channel, the second inlet cooling channel extending between the coolant chamber and the trailing edge chamber, and wherein at least one outlet cooling channel of the one or more outlet cooling channels extends from the passageway to the coolant chamber on a second side of the second inlet cooling channel.

14. A cooling assembly comprising:

a coolant chamber disposed inside an airfoil of a turbine assembly, the coolant chamber configured to direct coolant inside the airfoil of the turbine assembly, the airfoil including a pressure side and a suction side and extending between a leading edge of the airfoil and a trailing edge of the airfoil along an axial length of the airfoil;

one or more inlet cooling channels extending from the coolant chamber to a passageway, the one or more inlet cooling channels fluidly coupled with the coolant chamber and configured to direct the coolant in a direction toward a trailing edge chamber of the airfoil, the trailing edge chamber fluidly coupled with at least one of the one or more inlet cooling channels, the trailing edge chamber disposed at the trailing edge of the airfoil and including an inner surface extending from the pressure side to the suction side, wherein the one or more inlet cooling channels are configured to direct at least a portion of the coolant to impinge on the inner surface of the trailing edge chamber;

one or more outlet cooling channels extending from the passageway to the coolant chamber, the one or more outlet cooling channels configured to direct at least a portion of the coolant in one or more directions away from the trailing edge chamber of the airfoil, wherein the trailing edge chamber is fluidly coupled with one or more trailing edge conduits, wherein the one or more trailing edge conduits are configured to direct at least a portion of the coolant out of the trailing edge chamber.

15. The cooling assembly of claim 14, wherein at least one of the one or more inlet cooling channels is disposed between at least one of the one or more outlet cooling channels and one of another outlet cooling channel or another inlet cooling channel.

16. The cooling assembly of claim 14, wherein at least one of the one or more inlet cooling channels is fluidly coupled with at least one of the one or more outlet cooling channels via the passageway.

17. The cooling assembly of claim 14, further comprising one or more suction side conduits fluidly coupled with a suction side inner surface of the airfoil within at least one of the one or more inlet cooling channels or at least one of the one or more outlet cooling channels, wherein the one or more suction side conduits are configured to direct a portion of the coolant toward the suction side of the airfoil.

18. The cooling assembly of claim 14, further comprising one or more pressure side conduits fluidly coupled with a pressure side inner surface of the airfoil within at least one of the one or more inlet cooling channels or at least one of the one or more outlet cooling channels, wherein the one or more pressure side conduits are configured to direct a portion of the coolant toward the pressure side of the airfoil.

* * * * *